US007651540B2

(12) United States Patent
Rao

(10) Patent No.: US 7,651,540 B2
(45) Date of Patent: Jan. 26, 2010

(54) METHOD FOR PRODUCING MULTICOLORED CARPET

(75) Inventor: Sundar Mohan Rao, Chattanooga, TN (US)

(73) Assignee: INVISTA Technologies S.A.R.l., Wilmington, DE (US)

( * ) Notice: Subject to any disclaimer, the term of this patent is extended or adjusted under 35 U.S.C. 154(b) by 163 days.

(21) Appl. No.: 11/491,748

(22) Filed: Jul. 24, 2006

(65) Prior Publication Data

US 2008/0016625 A1 Jan. 24, 2008

(51) Int. Cl.
*D06P 3/86* (2006.01)
*D06P 3/87* (2006.01)
*D06P 3/874* (2006.01)

(52) U.S. Cl. ..... 8/929; 8/478; 8/485; 8/481; 8/531; 8/637.1; 8/654; 8/638

(58) Field of Classification Search ..... 8/480, 8/481, 478, 485, 531, 637.1, 654, 638, 929; 112/410
See application file for complete search history.

(56) References Cited

U.S. PATENT DOCUMENTS 3,101,522 A * 8/1963 Hooper et al. ..... 28/159
3,439,999 A * 4/1969 Farber et al. ..... 8/480
4,095,940 A 6/1978 Weingarten
5,066,308 A 11/1991 Yeh et al.
5,199,958 A * 4/1993 Jenkins et al. ..... 8/539
5,223,196 A * 6/1993 Shridharani et al. ..... 264/78
5,354,342 A * 10/1994 Jenkins ..... 8/481
5,445,653 A 8/1995 Hixson et al.
5,756,020 A 5/1998 Locke et al.
6,090,494 A * 7/2000 Rao ..... 428/475.2
2002/0114917 A1 8/2002 Kobayashi et al.
2004/0133997 A1 * 7/2004 Kelly et al. ..... 8/549

FOREIGN PATENT DOCUMENTS

WO WO 2001/094690 12/2001

* cited by examiner

*Primary Examiner*—Lorna M Douyon
*Assistant Examiner*—Amina Khan
(74) *Attorney, Agent, or Firm*—Craig M. Sterner

(57) ABSTRACT

A method of producing a multicolored textured carpet comprises blending a polyamide polymer and a color pigment to form a melt blend, extrusion spinning the melt blend to form pigmented polyamide yarns, tufting (1) the pigmented polyamide yarns and (2) white dyeable polyamide yarns into a carpet, and overdyeing the carpet with an amount of acid dye sufficient to produce the multicolored textured carpet. The color pigment and the acid dye are selected to provide desired multicolored effect in the carpet. The multicolored textured carpet having deeper color and dye light fastness is also disclosed.

7 Claims, No Drawings

METHOD FOR PRODUCING MULTICOLORED CARPET

FIELD OF THE INVENTION

This invention relates to a method for producing multicolored articles (e.g. carpets) from polyamide fibers and yarns. More specifically, the carpets are made by simultaneously tufting polyamide fibers and yarns that incorporate color pigments with white dyeable polyamide fibers and yarns, and the tufted carpets are thereafter overdyed with acid dyes and/or cationic dyes. The resulted fibers and yarns display deeper and richer color compared to multicolored articles made from conventional methods. The method of the invention is specifically applicable to fibers and yarns made from acid and/or cationically dyeable polyamide polymers, and can produce almost any shades and variety of multi-colors in the fibers and yarns which have greater depth than the base color of the initial pigmented fiber and yarns.

BACKGROUND OF THE INVENTION

Carpets made from synthetic polymer yarns, and particularly polyamide yarns, such as nylon, are popular floor coverings for residential and commercial applications. Such carpets are relatively inexpensive and have a desirable combination of qualities, such as durability, aesthetics, comfort, safety, warmth, and quietness. Further, such carpets are available in a wide variety of colors, patterns, and textures. Polymer, and particularly polyamide, yarns are preferred for carpeting because they can be dyed easily with acid or other types of dyes. Random or irregular multicolor carpets are very popular especially for commercial use.

A multicolored carpet is traditionally made from tufting multicolored yarns which are produced through an expensive skein dyeing or knit-de-knit space dye process. In skein dyeing, large, loosely wound skeins of yarns are placed in a skein kier for dyeing. Space dyeing refers to a method of dyeing yarns with multiple colors printed on each strand. Such processes can produce a variety of visually appealing effects in carpets, including well differentiated color points in an unorganized design. However, the dyeing process is so slow and inefficient that high cost is added to carpets. In addition, the dyeing process itself has environmental drawbacks by generating a large amount of waste water.

Colored pigments have long been incorporated into the fibers comprising polyamide and other polymer yarns to create durable colored carpets which maintain their color in spite of wear because, unlike most dyed fibers, the color is incorporated throughout the fiber.

Such color pigmented fibers enjoy permanent coloration which is not removed by washing, and are more resistant to degrading and fading under ultraviolet light, and exhibit improved resistance to chemicals and nitrous oxide fumes than dyed fibers. However, the process of adding pigments to fibers tends to be more expensive than dyeing, especially at the high pigment concentrations required for deep colors. While pigmented fibers offer color fastness advantages, the number of colors required to satisfy customer preferences in the market place is huge and the cost of manufacture and inventory maintenance increases dramatically as the number of available colors increases. Therefore, the pigmented fibers are not well suited for directly use in efficiently producing multicolored yarns or multicolored articles.

One objective of the invention is to develop a new method for making a multicolored article whereby an article made from substantially uniformly colored pigmented polyamide yarns and white acid dyeable polyamide yams, and the article is thereafter overdyed with "work-horse" acid dyes and other external dyes.

Another objective of the invention therefore is to provide a multicolored carpet or other overdyed multicolored article which enjoys the superior durability of pigmented polymer fibers, such as polyamide (e.g., nylon) fibers, along with the quality of appearance, color, dye depth, and ease of manufacture that dyeing processes yield today.

BRIEF SUMMARY OF THE INVENTION

The invention provides a method of producing a multicolored article, such as a carpet, from tufting the carpet using pigmented polyamide yarns combined with white dyeable polyamide yarns and overdyeing the carpet while improving color depth and dye light fastness. The method comprises the successive step of:

(a) blending a polyamide polymer and a color pigment to form a melt blend and extrusion spinning the melt blend to form pigmented polyamide yarns, (b) tufting (1) the pigmented polyamide yams of step (a) and (2) white acid dyeable nylon yarns into a carpet, (c) overdyeing the carpet prepared in step (b) with an amount of acid dye sufficient to produce the multicolored carpet, wherein the color pigment and the acid dye are selected to provide desired multicolored effect in the carpet.

The polyamide polymer can be either acid dyeable polyamide polymer or cationically dyeable polyamide polymer. Thus pigmented polyamide yarns can be either pigmented acid dyeable polyamide yarns or pigmented cationically dyeable polyamide yarns.

The tufted carpet can be dyed with a acid dyes or a mixture of acid and cationic dyes if the carpet contains cationically dyeable polyamide yarns.

White cationically dyeable yarns are added and mixed with white acid dyeable yarns in step (b), and the tufted carpet is then overdyed with either acid dyes or a mixture of acid and cationic dyes.

Multicolored articles prepared from pigmented yarns with white acid dyeable yarns and/or white cationically dyeable yarns then overdyed have a surprisingly greater depth of color compared to those made from traditional methods without color pigments. Overdyeing of these articles made from pigmented and white dyeable yarns can be conducted to achieve almost any multicolored articles with greater depths of colors.

DETAILED DESCRIPTION OF THE INVENTION

This invention provides a procedure for preparing a multicolored article with richer and deeper color compared to that made from a traditional process. The subject invention discloses a method of making an article by combining pigmented yarns with white dyeable yarns, and overdyeing the article with other types of surface or external dyes to produce a multicolored substrate exhibiting improved depth of color and durable lightfast characteristics. A multicolored carpet is created according to this invention using acid and/or cationically dyeable polyamide yarns.

Colored pigments are added into polyamide yarns during the extrusion and spinning process. The pigmented yarns are then combined with white acid dyeable and/or white cationically dyeable nylon yarns, and simultaneously tufted into a carpet. The carpet is then overdyed with an acid dye and/or cationic dye. The pigments used in producing the yarns have different colors from the acid dyes and/or cationic dyes.

Variations in the colors of the pigmented yarns, acid dyes, cationic dyes, relative amounts and positioning of different types of yarns, their construction into carpets and other factors all provide various styling for the carpets.

The addition of color pigments into a polymer during the extrusion is also referred as a solution dyeing technique. The technique is known to produce very colorfast materials, because the color is locked into the polymer itself. However, the number of yarn styles and colors that are solution dyed is limited for economic reasons. The fiber manufacture must produce substantial quantities of fibers to justify the expense of adding extra step during the manufacture process. Furthermore, fiber production takes place well in advance of the time when fabrics reach the market. Fashion color trends may change fairly rapidly, so that, by the time of a solution dyed fabric reaches the market, the color may be out of fashion. For these reasons, solution dyed fabrics generally have basic large volume styles and colors constructed from standard yarns.

Overdyeing a mixture of solution dyed and white dyeable yarns would allow substrates to be dyed in a wide variety of colors, and would provide a multicolored article with a high level of colorfastness and greater depth of color. It also transforms a solution dyed substrate that consist of a few base color shades into a substrate with a wide variety of colors and shades by other dyeing methods. Thus, it would reduce waste in the form of unused solution dyed substrates, obsolete yarns, and would allow reduced lead times on customer color orders. Additional benefits would include reduced inventory carrying costs and reasonable economies of scale in yarns production.

The polymers in the present invention include polyamides in general and nylons in particular, including nylon 6; nylon 6 , 6; nylon 4, 6; nylon 6, 12 and blends and copoloymers thereof. It is anticipated that other polymeric fibers comprising polylactic acid, polyester and blends and copolymers thereof, would also benefit from this invention through the incorporation of pigments into the fibers and then over-dyeing with disperse dyes or reactive dyes on either a yarn prepared from the color pigmented fiber or an article made of yarns comprising the color pigmented fiber.

Nylon carpet fiber is generally classified as two types, depending upon its receptivity, to acid dyes and base or cationic dyes. Cationically dyeable nylons contain sufficient $SO_3H$ group or COOH groups within the polymer structure, which are receptive to cationic or basic dyes to render the fiber dyeable to a cationic dye. Acid dyeable nylons are essentially conventional nylons, such as polyhexamethylene adipamide and polycaprolactam. Acid dyeable nylons vary as to type and are characterized as being weakly dyed with acid dyes, average dyed with acid dyes, or deeply dyed with acid dyes. In one embodiment, acid dyeable nylon polymer is solution dyed to form a base color. In yet another embodiment, cationically dyeable nylon polymer is solution dyed to form a base color.

As described herein, a solution dye process simply includes adding a pigment, dye or other colorant to a polymeric material in a melt extrusion and fiber spinning process. A color pigment is selected from one or any combination of the three families of the trichromatic dye color system (blues, yellows, reds) that can be added to a polymeric fiber in an amount sufficient to produce color pigmented fiber. Optionally, $TiO_2$ and/or black pigments can be added in the above process. Preferable color pigments are stable in light (color fast) as well as fastness against wet bleeding.

Suitable color pigments include but are not limited to these following color pigments, as found in the color families of the trichromatic dye system:

Reds—Pigment Red 60, Pigment Red 63, Pigment Red 80, Pigment Red 66, Pigment Red 67, Pigment Red 81, Pigment Red 68, Pigment Red 73, Pigment Red 83;

Yellows—Pigment Yellow 65, Pigment Yellow 82, Pigment Yellow 85, Pigment Yellow 87; and Blues—Pigment Blue 61, Pigment Blue 69, Pigment Blue 74, Pigment Blue 78.

Black pigment can optionally be added to further reduce the L* value (a value of lightness or darkness as measured by a spectraphotometer). Suitable black pigments include but are not limited to Pigment Black 64 and Pigment Black 72. The inclusion of black pigment is to be practiced in addition to the color pigments selected from at least two of the color families of the trichromatic dye color system, and the amount of black pigment loading should be considered as part of the total color pigment loading.

$TiO_2$ in the anatase or rutile forms, a white pigment, is commonly added as a delusterant to polyamide yarns. $TiO_2$ increases L* or whiteness of fiber. $TiO_2$ tends to have a deleterious effect on UV light resistance and should therefore be minimized.

In this invention, the base shade of pigmented yarns should provide about 5% to about 95% of the total depth of color of the final shade. Thus, the total color pigment loading is in the range from about 5 ppm to about 20,000 ppm.

The pigments can be incorporated into the fibers in a variety of ways including master batch concentrate addition at the throat of extruder, blending polymer/concentrate mixtures, and extruding and injecting molten color concentrate/or pigments dispersed in a liquid carrier in the extruder or in a polymer melt transfer line. Adequate mixers as known in the art should be used to assure coloration uniformity.

Color pigmented fibers and yarns may be manufactured according to conventional melting, spinning and drawing processes known today and using equipment commonly used today or later developed in the production of polyamide, polylactic acid and polyester fibers and yarns. Due to the low loading and selection of the specific pigments, the spinning process presents no additional difficulty over the spinning of non-pigmented fiber. The color pigment loadings disclosed have not exhibited adverse effects in mixing, spinning and drawing operations, as has been observed at higher pigment loading levels. In a subsequent step, the pigmented nylon yarns are drawn and textured to form bulked continuous filament (BCF) yarns suitable for tufting into carpets. A typical technique involves combining the extruded or as-spun filaments into a yarn, then drawing, texturizing and winding a package, all in a single step. Then the pigmented BCF yarns are tufted with white dyeable BCF yarns into a backing to form a carpet. The BCF yarns are generally tufted into a pliable primary backing. Primary backing materials are selected from the group comprising conventional woven jute, woven polypropylene, cellulosic nonwovens, and nonwovens of nylon, polyester, and polypropylene.

The ratio of pigmented yarns to white dyeable yarns varies depending on the desired styling. In one embodiment, the ratio is in the range of from about 15% to about 50% in yarn bundles. In another embodiment, the ratio is in the range of from about 15% to about 99% in carpets.

The carpets prepared from the mixed yarns are then overdyed, preferably using conventional "work horse" acid dyes, in order to form a desired substantially multicolored carpet with greater depth of color. The resulting carpets display a significant improvement in depth of color, compared to the carpets prepared by dyeing only white yarns to different colors. The process of the invention can be used to produce an overdyed fabric of almost any multicolor currently attainable in the trichromatic dye color system.

Piece dyeing is a technique generally used when fabrics are to be dyed on solid color. In piece dyeing, a finished fabric is passed through a dye bath in which the fabric absorbs the dyestuff. Piece dyeing includes such methods as beck dyeing, jet dyeing, jig dyeing, beam dyeing, pad dyeing, vacuum impregnation, and foam dyeing. The process of dyeing may include short space dyeing, and long space dyeing. Any known piece dyeing technique can be used for overdyeing a tufted carpet in this invention Dyes that may be used in conjunction with the invention to overdye pigmented and white dyeable yarns include acid dyes, pre-metallized acid dyes, disperse dyes, vat dyes, cationic dyes and reactive dyes. The dye processes may employ a wide range of pH. In one embodiment, a pH is in the range from about 1.5 to about 7.0. The process of the invention may also provide a beneficial effect using pre-metallized acid dyes, which are essentially acidic in nature.

The invention will be described in greater detail in conjunction with the following, non-limiting examples.

EXAMPLE 1

This example used acid dyeable yarns to make a multicolored carpet using piece dye procedure.

Carpet A (Control Carpet) Preparation:

Acid dyeable BCF yarns, 1245-496A and 1245-296A, were used in control item A. The yarns were made in Invista and commercially available. The yarns were 2 ply self-twisted, and the twist level was 4.5 Twists per inch. The twisted yarns were heat set at 265° F. in Superba heat set unit, and then were tufted into a 28 oz loop pile carpet in 1/10" gauge with pile height of 7/32". The carpet was dyed to a beige color in a dye bath using 0.03% Owf (weight on fiber) of Yellow 3G, 0.0144% Owf of Red 2B, 0.0168% Owf of Blue 4R, and finished with a vinyl sheet coating.

Carpet B (Test Carpet of the Invention) Preparation:

Gray test BCF yarns were made from feeding red, blue, yellow, and black pigments into the throat of a twin screw extruder which was melting Nylon 66 polymers. The blended melt was spun into yarns of the denier and cross section similar to 1245-496A. The yarns were then 2 ply self-twisted. The twist level of the gray test BCF yarns and acid dyeable BCF yarns, 1295-496A, was 4.5 Twists per inch, and heat set at 265° F. in Superba heat set unit. The gray test BCF yarns and acid dyeable BCF yarns were tufted into a 28 oz loop pile carpet in 1/10" gauge with pile height of 7/32". This carpet was then dyed to a beige color in a dye bath using 0.03% Owf of Yellow 3G, 0.0144% Owf of Red 2B, 0.0168% Owf of Blue 4R and finished with a vinyl sheet coating.

Yarns were then stripped from the loop pile carpet in Example 1. L* values of the yarns were measured using a spectraphotometer. The experimental results indicated that carpet B had a much stronger and differentiated multicolored look than carpet A. Carpet A had a multicolored look via dye uptake differences in the two different acid dyeable yarns. For carpet B, both the test gray yarns and the acid dyeable yarns had much darker shades when the carpet B was dyed with the same dye concentrations as in carpet A as showed in Table 1. L* values of the yarns in carpet B were less than those from carpet A, which indicated the yarns had darker shades in carpet B. In addition, the test carpet B had a more distinctive multicolored look than carpet A.

TABLE 1

L* value of the yarns stripped from loop pile in Example 1

| Carpet Sample | BCF Yarns | L* |
|---|---|---|
| Carpet A in | 1245-496A | 69.68 |
| Example 1 | 1245-296A | 64.83 |
| Carpet B in | 1245-496A | 68.70 |
| Example 1 | 1B Gray Test Yarn | 59.37 |

EXAMPLE 2

This example used acid dyeable and cationically dyeable yarns to make a multicolored carpet using piece dye procedure.

Carpet A (Control Carpet) Preparation:

Two acid dyeable BCF yarns, 1245-496A and 1245-296A, and one cationically dyeable BCF yarn, 1245-294A, were used in control item A. All the yarns were made in Invista and commercially available. The yarns were 2 ply self-twisted. The twist levels in all three cases were 4.5 Twists per inch, and these twisted yarns were heat set at 265° F. in Superba heat set unit. The three yarns were tufted into a 28 oz loop pile carpet in 1/10" gauge with pile height of 7/32". The carpet was then dyed in a dye bath containing a mixture of acid and cationic dyes. The acid dye composition was 0.03% Owf (weight on fiber) of Yellow 3G, 0.0144% Owf of Red 2B, and 0.0168% Owf of Blue 4R to enable dyeing acid yarns to a beige color. The cationic dye composition was 0.275% Owf of Red YCN, and 0.02% Owf of Blue ACN, to enable dyeing the cationically dyeable yarns to rust color. The carpet was dried, and finished with a vinyl sheet coating.

Carpet B (Test Carpet of the Invention) Preparation:

One regular acid dyeable yarn, 1245-496A, one gray test yarn from this invention, and one cationically dyeable yarn, 1245-294A were used to make the test carpet B. The gray test BCF yarn was spun by feeding red, blue, yellow, and black pigments into the throat of a twin screw extruder which was melting Nylon 66 polymer. The blended melt was spun into yarns with the same denier and cross section as 1245-496A. All the yarns were 2 ply self-twisted. The twist level was 4.5 Twists per inch, and heat set at 265° F. in Superba heat set unit. These three yarns were tufted into a 28 oz, loop pile carpet in 1/10" gauge, with pile height of 7/32". This carpet was then dyed with a mixture of acid and cationic dyes. The acid dye comprised 0.03% Owf of Yellow 3G, 0.0144% Owf of Red 2B, 0.0168% Owf of Blue 4R, and generated beige color. The cat dye comprised 0.275% Owf of Red YCN, 0.02% Owf of Blue CAN, and generated rust color. The carpet was dried, and finished with a vinyl sheet coating.

Yarns were then stripped from the loop pile carpet in Example 2. L* values of the yarns were measured using a spectraphotometer. The experimental result also indicated that carpet B had a much stronger and differentiated multicolored look than carpet A as shown in Table 2. L* values of the yarns in carpet B were less than those from carpet A.

TABLE 2

L* Value of Yarns Stripped from Loop Pile in Example 2

| Carpet Sample | BCF Yarns | L* |
|---|---|---|
| Carpet A in | 1245-496A | 76.26 |
| Example 2 | 1245-296A | 63.90 |
| | 1245-294A | 63.01 |

TABLE 2-continued

L* Value of Yarns Stripped from Loop Pile in Example 2

| Carpet Sample | BCF Yarns | L* |
|---|---|---|
| Carpet B in Example 2 | 1245-496A | 70.98 |
| | 2B Gray Test Yarn | 59.57 |
| | 1245-294A | 62.53 |

What is claimed is:

1. A method for preparing a multicolored carpet comprising the successive steps of:

(a) melt blending an acid dyeable polyamide polymer and a color pigment and extrusion spinning the melt blend to form pigmented acid dyeable polyamide yarns, (b) tufting (1) the pigmented acid dyeable polyamide yarns of step (a) with (2) white acid dyeable polyamide yarns and (3) white cationically dyeable polyamide yarns into a carpet, and (c) overdyeing the carpet prepared in step (b) with an a mixture of acid dyes and cationic dyes to produce the multicolored carpet, wherein the color pigment and the dyes are selected to provide multicolored effects in the carpet.

2. The method of claim 1, wherein the color pigment selected from the group consisting of Pigment Red 60, Pigment Red 63, Pigment Red 80, Pigment Red 66, Pigment Red 67, Pigment Red 81, Pigment Red 68, Pigment Red 73, Pigment Red 83, Pigment Yellow 65, Pigment Yellow 82, Pigment Yellow 85, Pigment Yellow 87, Pigment Blue 61, Pigment Blue 69, Pigment Blue 74, and Pigment Blue 78.

3. The method of claim 1, wherein the blend of the acid dyeable polyamide polymer and the color pigment includes a black pigment.

4. The method of claim 1, wherein the dye in step (c) is a premetalized acid dye.

5. The method of claim 1, wherein step (c) is performed at a pH in the range of from about 1.5 to about 7 and at a temperature in the range of from about 70° C. to about 100° C.

6. The method of claim 1, wherein the acid dyeable polyamide polymer is selected from the group consisting of nylon 6, nylon 6, 6, nylon 4, 6, nylon 6, 12, and blends and copolymers thereof.

7. The method of claim 1, wherein overdyeing in step (c) is piece dyeing.

* * * * *